US006314585B1

(12) United States Patent
Mann

(10) Patent No.: US 6,314,585 B1
(45) Date of Patent: Nov. 13, 2001

(54) PROCESS OF MAKING IMAGE-DISPLAYING GARMENTS

(76) Inventor: Charles D. Mann, 1513 E. Burnsville Pkwy., Burnsville, MN (US) 55337

( * ) Notice: Subject to any disclaimer, the term of this patent is extended or adjusted under 35 U.S.C. 154(b) by 0 days.

(21) Appl. No.: 09/771,813

(22) Filed: Jan. 29, 2001

(51) Int. Cl.[7] ..... A41D 27/08; G06F 19/00

(52) U.S. Cl. ..... 2/243.1; 2/246; 40/586; 700/135

(58) Field of Search ..... 2/243.1, 244, 246; 112/104, 407.05; 40/586; 700/135, 130, 131

(56) References Cited

U.S. PATENT DOCUMENTS 5,005,219 * 4/1991 Diaz ..... 2/244
5,058,174 * 10/1991 Carroll ..... 382/1
5,084,915 * 2/1992 Shotwelkl et al. ..... 2/115
5,487,011 * 1/1996 Chaiken ..... 364/470
5,825,652 * 10/1998 LeBlond ..... 364/470.03
5,831,857 * 11/1998 Clarino et al. ..... 364/470.06

* cited by examiner

*Primary Examiner*—John J. Calvert
*Assistant Examiner*—Robert H. Muromoto, Jr.
(74) *Attorney, Agent, or Firm*—Westman, Champlin & Kelly, P.A.

(57) ABSTRACT

A process is provided for making a garment having at least one image at a selected position on the garment. A marker is created containing a sight point and an identification of the bounds of at least some of the pieces of the garment. The position and orientation of the image relative to the sight point on the marker is identified such that the image is at a selected position within the identified bounds of at least one of the pieces. A sight point and at least one image are printed on the raw fabric, the image being printed at a position and orientation relative to the sight point on the fabric that is the same as the relation of the position and orientation of the image to the sight point on the marker. The marker is positioned relative to the fabric so that the sight points are aligned, and the fabric is cut into garment pieces which are assembled to form the garment.

16 Claims, 6 Drawing Sheets

PROCESS OF MAKING IMAGE-DISPLAYING GARMENTS

FIELD OF THE INVENTION

This invention relates to garment production and particularly to the application of images, such as logos, cartoon characters and other special designs, to specific locations on garments during layout and assembly of the garment without additional post-assembly steps.

BACKGROUND OF THE INVENTION

Apparel production begins with basic patterns, or slopers. The designer's original sketch for a garment is translated into muslin—a plain white fabric that shows the grain or direction of the woven thread. The muslin is marked, cut, and sewn into a sample garment. Duplicate samples are then created and corrected to ensure that the pattern is true. The duplicate is then graded into a range of pattern sizes.

Nearly all garments are composed of multiple pattern pieces. Each piece must have clear boundaries and seam allowance added to their borders. Each piece of the pattern size is laid out in a way that will fit the most pattern pieces on the least amount of fabric. This layout, or marker, is used to guide the actual cutting of all pieces laid out on the fabric. Inexpensive garments are often made by stacking the fabric in as many as several hundred plies that are cut simultaneously using a computerized cutting system, although garments that use thicker or heavier thread count or heavier woven fabrics are made in smaller stacks, such as between 5 and 50 plies. Expensive garments are usually formed individually.

A wide variety of cutting systems are used to cut fabric into garment pieces, including knives, saws, shears and laser beam cutting devices. The cutting system might be manually-operated or computer-guided. Where the cutting system is computer-guided, the layout or marker may be digitally encoded in the memory of a computer to guide the cutting system to cut the fabric, or stack of fabric, to form the garment pieces. In this case, the marker is an electronic rendition of the garment pieces. In manually-operated cutting systems, the layout or marker is usually physically attached to, or drawn on, the fabric, or stack of fabric. In this case, the layout or marker is a physical rendition of the garment pieces drawn on a sheet of marker paper that is attached to the fabric (or top layer of the fabric in the case of a stack) with a tacking spray that holds the paper marker in place on the fabric. In either case, the layout or marker guides the cutting system to cut the garment pieces from the fabric.

The pieces of a single marker may comprise all of the pieces of the completed garment, or may comprise multiple copies of one or several pieces of the garment. It is common to assemble a garment made of pieces patterned with different markers, particularly where the garment is formed from different materials.

The process of assembling a garment is also often automated. Computerized sewing machines stitch the garment pieces using a variety of stitch patterns in sequential steps that position and sew the pieces into the finished garment. More expensive garments might be sewn with human-operated sewing machines.

The raw fabric used to make a garment often includes a pattern of images that is repeated at regular intervals along the length and width of a bolt of raw fabric. This fabric, called a print fabric, is formed by dyeing the fabric to form the repeat pattern. For example, a rotary applicator having a mirror image of the pattern embossed thereon might be used in a rotary screen printing process that repeats the pattern each $\pi d$ along the length of the bolt, where d is the diameter of the actuator. In most finished garments the image pattern and the repeat of the image pattern in the print fabric play no role in planning the completed garment. The placement of the image pattern in relation to each other and in relation to the interval between the repeat pattern on the raw fabric are irrelevant in laying out the markers and cutting and assembling the garment pieces. Thus, the image pattern and pattern repeat are not relevant to planning of images at seams between pieces in the completed garment.

For some garments the layout, or marker, is positioned relative to the image pattern on the fabric to achieve an aesthetically pleasing garment. When this level of planning takes place the image(s) of the print may be centrally located on the completed garment, but the pattern repeat will cause the image pattern to run into the seams of the garment.

Where an image, such as a word, phrase, sports team logo, corporate logo, cartoon character, etc. is to be positioned at a specific position on a garment, the image is added to the garment after the individual component pieces of the garment are cut from bulk fabric or after construction of the full garment. The images are added to a jacket or other garment by any of several techniques, including silk screening, stitching, embroidering, and sewing on a separate applique or decal. It is usually quite expensive to add a single image or multiple images to a garment. Additional handling and post-assembly processing is required, and the process is labor-intensive. There is a need, therefore, for a technique to add specifically positioned images to garments in a less expensive, less labor-intensive manner.

SUMMARY OF THE INVENTION

The present invention is directed to a technique for adding images to raw fabric before cutting the fabric into garment pieces, such that each image is positioned at a selected position on the assembled garment.

In accordance with the present invention, a marker is created containing a sight point and an identification of the bounds of at least some of the pieces of the garment. The position and orientation of the image relative to the sight point on the marker is identified such that the image is at a selected position within the identified bounds of at least one of the pieces. A sight point is printed on the raw fabric, and at least one image is printed on the raw fabric at a position and orientation relative to the sight point on the fabric that is the same as the relation of the position and orientation of the image to the sight point on the marker. The marker is positioned relative to the fabric so that the sight point on the marker is aligned with the sight point on the fabric. The fabric is cut into garment pieces based on the bounds of the pieces on the marker. The garment is assembled using at least one garment piece bearing the image.

In one form of the invention, the garment is produced in quantity by cutting the bolts of fabric into plies suitable for simultaneous application of the marker and cutting. In this case, the image printing is repeated along the length of the bolt of raw fabric, and the fabric is cut between selected repeats of the images at cut lines related to the sight point. The fabric is then stacked and the marker is applied to the top-most ply of the stack. The entire stack is cut, forming garment pieces from each ply of the stack simultaneously.

DETAILED DESCRIPTION OF THE PREFERRED EMBODIMENTS

Figure 1:
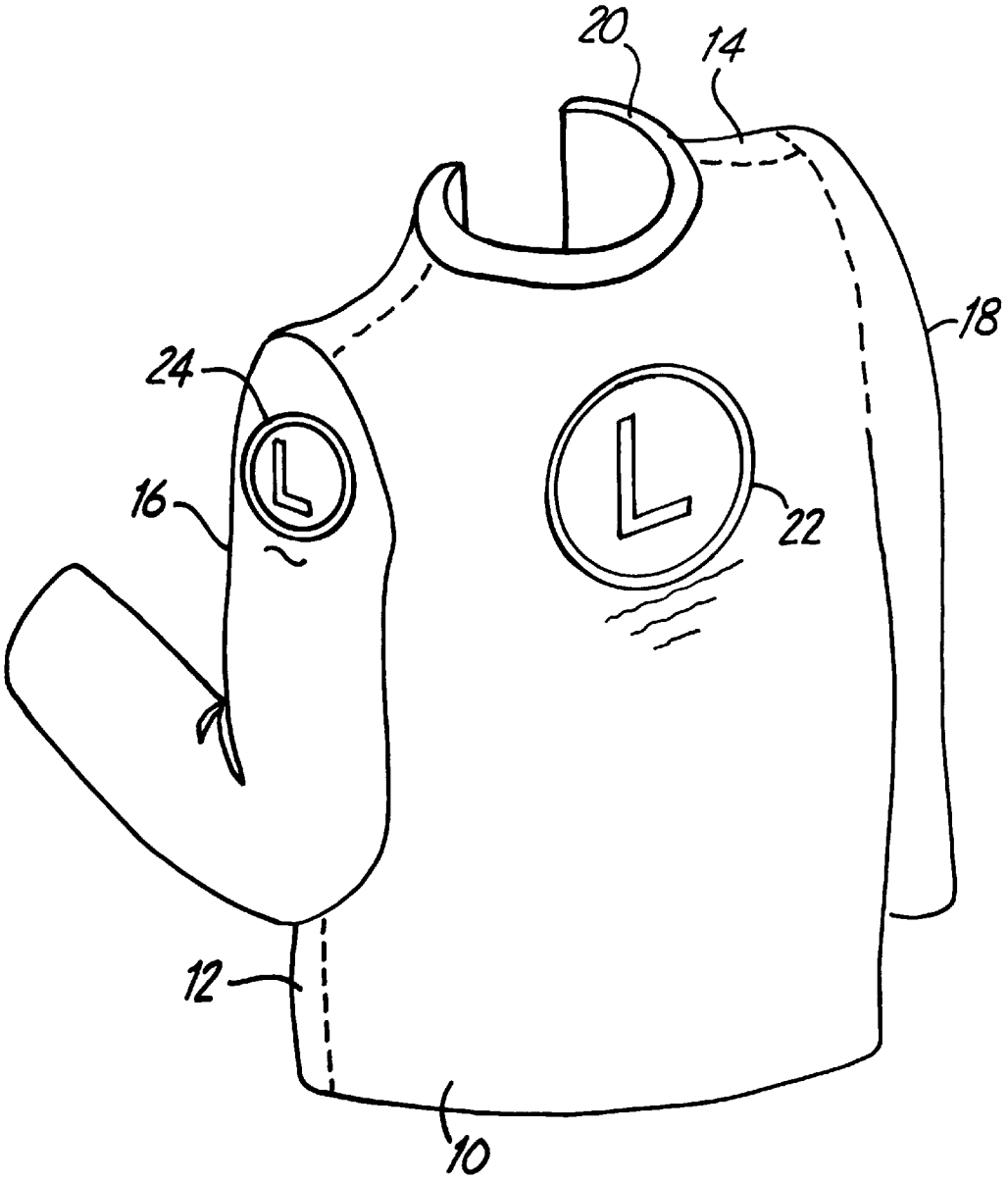
FIG. 1 is a perspective view of a jacket constructed in accordance with the process of the present invention.

FIG. 1 is a perspective view of a garment, in this case a jacket, made in accordance with the present invention. The jacket includes a back panel 10, front panels consisting of a left side front panel 12 and a right side front panel 14, a left sleeve 16, a right sleeve 18 and a collar 20. An image 22 may appear on the back panel of the jacket and another image 24 appears on the left sleeve panel 16. Other images 26 and 28 (not shown in FIG. 1) may appear elsewhere on the garment, such as on the right sleeve or a front panel.

As used herein, the term "image" means a word, phrase, sports team logo, corporate logo, cartoon character, group of cartoon characters, and combinations thereof, and any other image intended to convey a message, theme or design. The position of the image on the garment is not controlling on the present invention, except that the image is positioned at a predetermined location on the finished garment. Ordinarily, but not necessarily, the image is positioned to not run into the seam, and not be joined with any other image on an adjacent panel. As will be understood, the image and its location on the garment is selected before dyeing the fabric that will make the garment pieces on which the image will appear.

Figure 2:
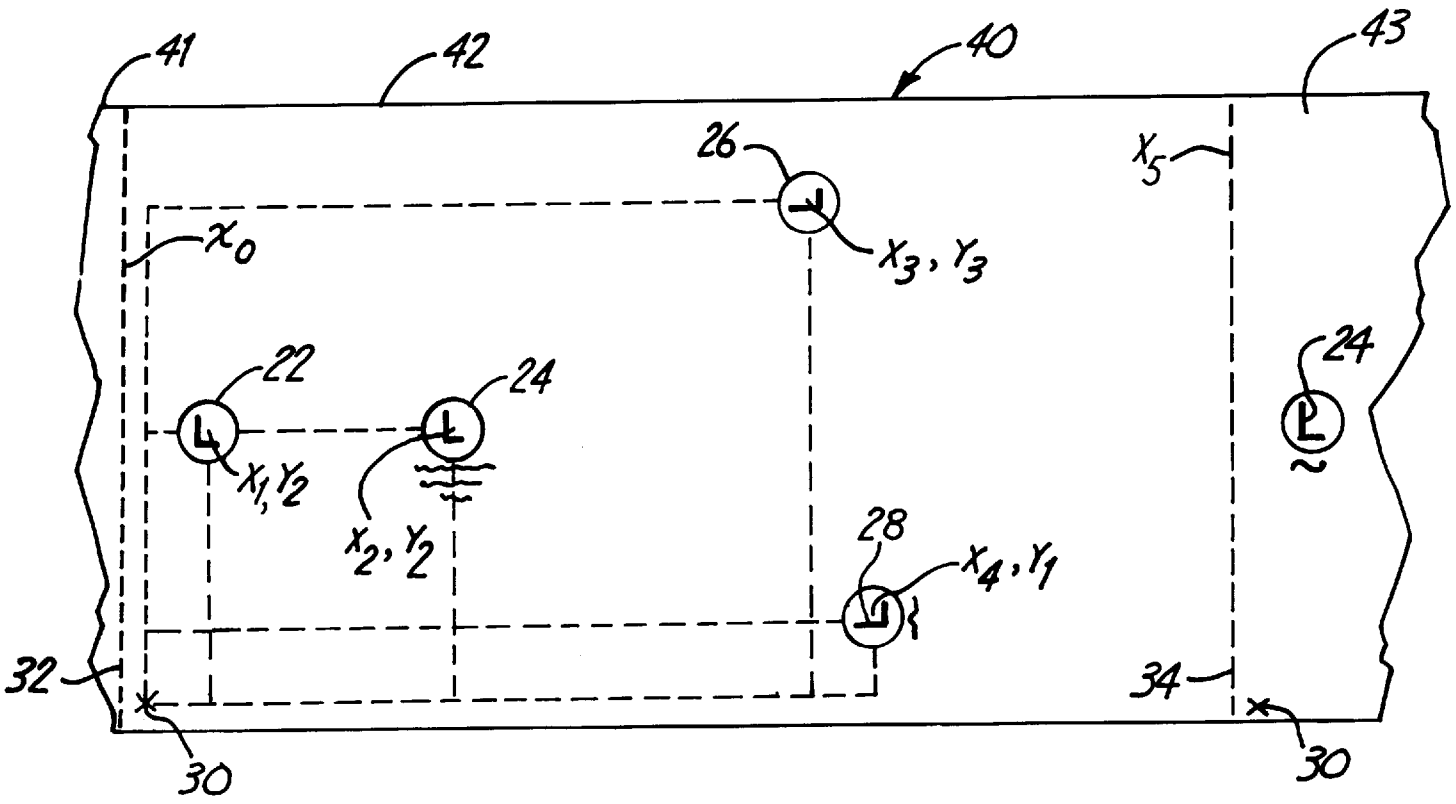
FIG. 2 is a plan view of a portion of a bolt of raw fabric used to make the jacket illustrated in FIG. 1.

The garment illustrated in FIG. 1 is fabricated from the fabric illustrated in FIG. 2. As shown in FIG. 2 a portion 40 of a bolt of fabric includes images 22, 24, 26, and 28 positioned at predetermined orientations and positions relative to a sight point 30. An x,y grid is laid out on the fabric and a dye pattern is laid out on a ply 42 between lines 32 and 34. The dye pattern contains images 22, 24, 26 and 28, with each image having center coordinates relative to sight point 30. Thus, the sight point 30 is at x=0 and y=0 coordinates and each image has a unique set of x,y center coordinates. Thus, image 22 is positioned at $x_1,y_2$, image 24 is positioned at $x_2,y_2$, image 26 positioned at $x_3,y_3$ and image 28 is positioned at $x_4,y_1$ relative to sight point 30 at 0,0.

Figure 3:
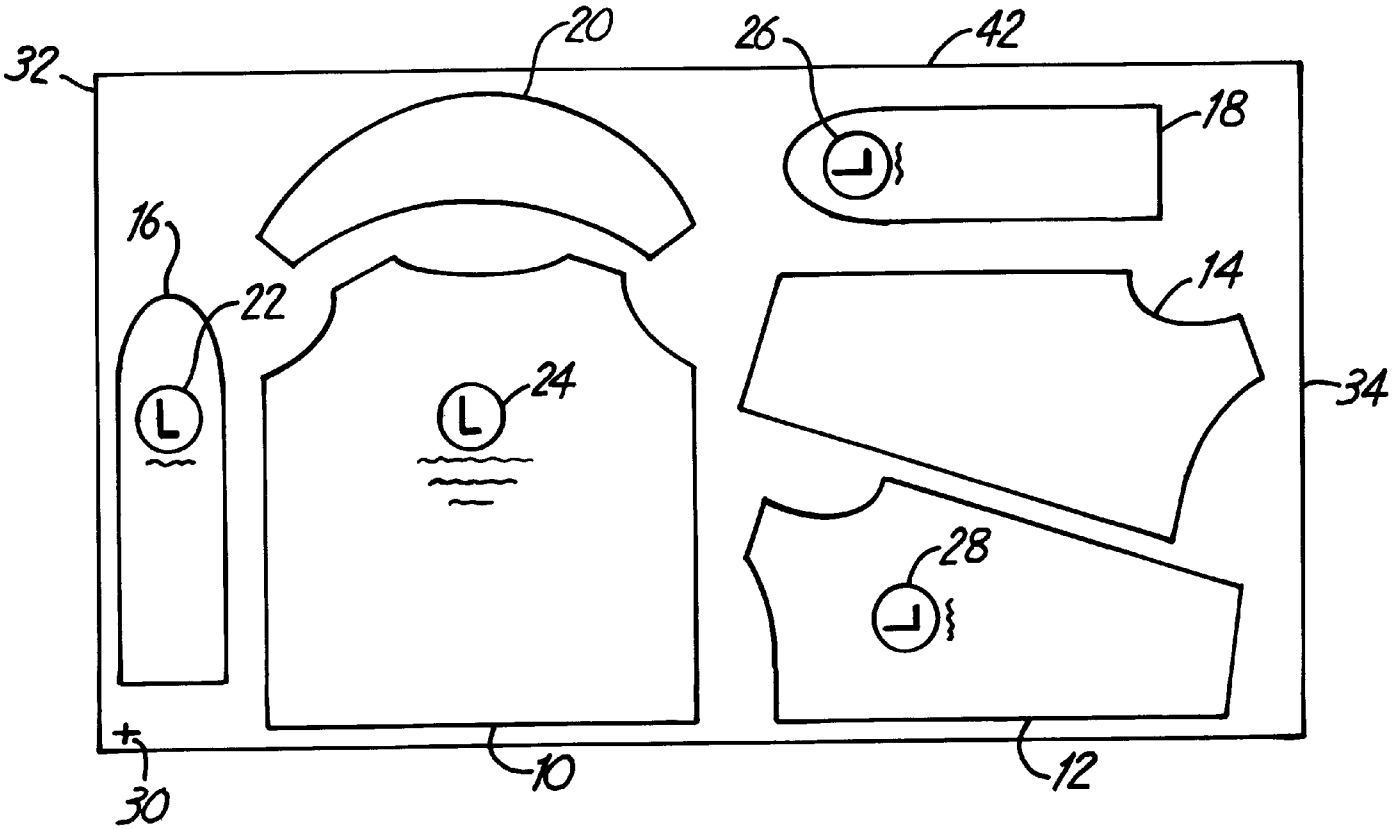
FIG. 3 is a plan view of the fabric illustrated in FIG. 2 with a layout or marker shown thereon.

Images 22, 24, 26 and 28 are sized and oriented relative to the length of the fabric illustrated in FIG. 2 based on the position of the layout or marker for the garment as illustrated in FIG. 3. Ordinarily, the x,y grid lines are not marked on the fabric, but instead are employed for reference in establishing the print pattern. If the printing process is computer controlled, the grid pattern, image sizing and image rotational position is stored in the computer memory. If the images are applied by a rotary screen printing process, the image sizing and rotational position and x,y print position are established on the fabrication of the rotary applicator.

The images and sight point 30 are printed onto the fabric at the coordinates identified and in the orientation required. The position of sight point 30 may be any place within ply 42, preferably outside any of the garment pieces defined by the marker. The grid lines and cut lines 32 and 34 are not printed, but are employed for reference only. The fabric has a pattern repeat at lines 32, 34, such that a panel or ply 42 follows ply 41 and precedes ply 43, each ply having the same layout of images as shown on ply 42.

If the garment is being mass-produced, the fabric is cut along lines 32 and 34 and stacked for cutting. As illustrated in FIG. 3, the marker or layout is laid out on the fabric based on the sight point 30 printed on the fabric. Thus, an optical detector or other suitable apparatus locates the position of sight point 30. Using the same x,y grid pattern, the marker is positioned relative to the fabric so that the pieces 10, 12, 14, 16, 18 and 20 are positioned relative to images 22, 24, 26 and 28 so that the images appear in desired positions on the garment pieces, and hence on the garment. Automatic cutting apparatus may be used to cut the garment pieces from the fabric employing the marker stored in the cutting apparatus computer memory. The completed pieces are then assembled in a well known manner into the garment of FIG. 1.

Figure 4:
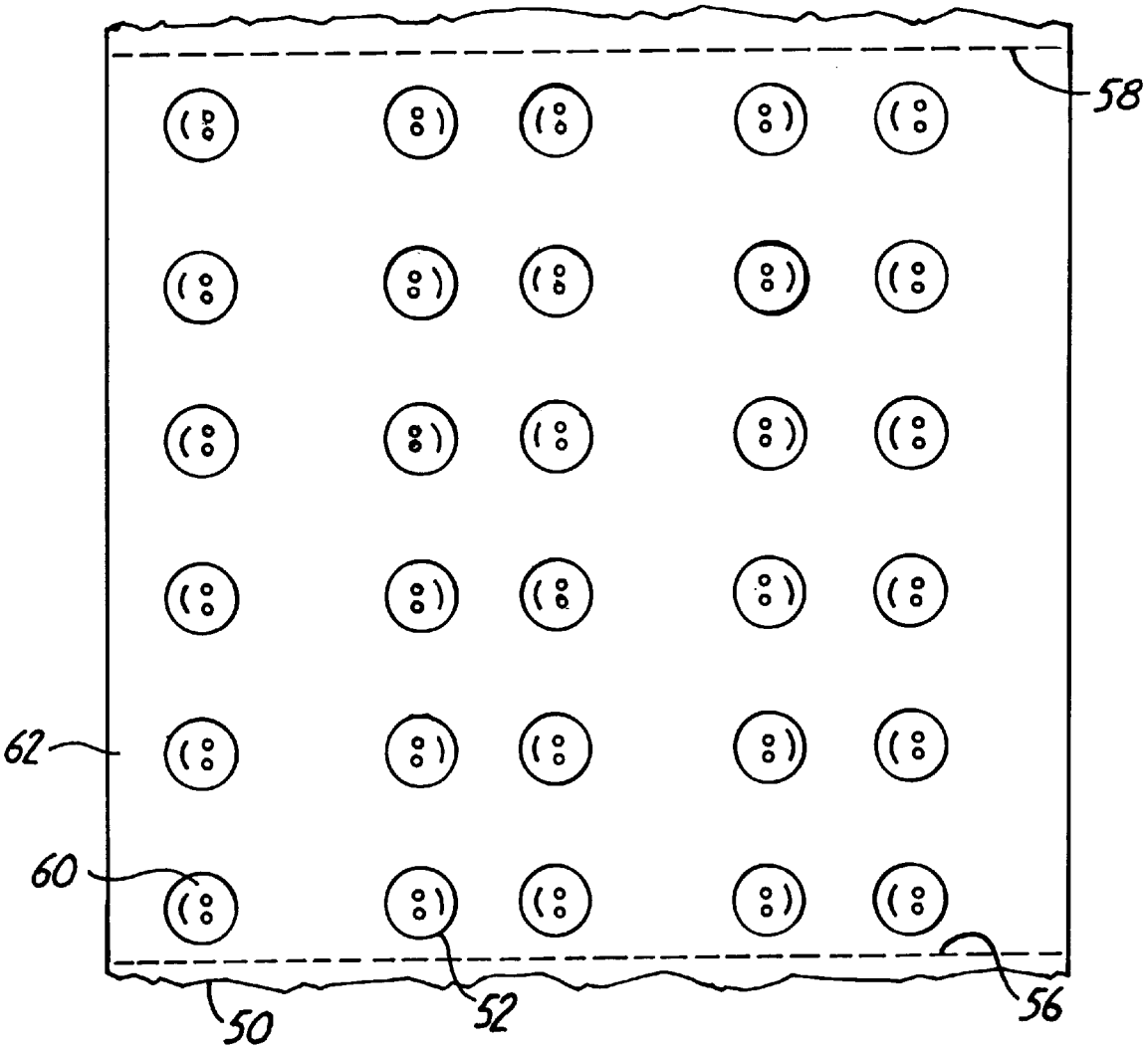
FIG. 4 is a plan view of a portion of a bolt of raw fabric used to make selected panels of the jacket illustrated in FIG. 1 in accordance with another embodiment of the present invention.
Figure 5:
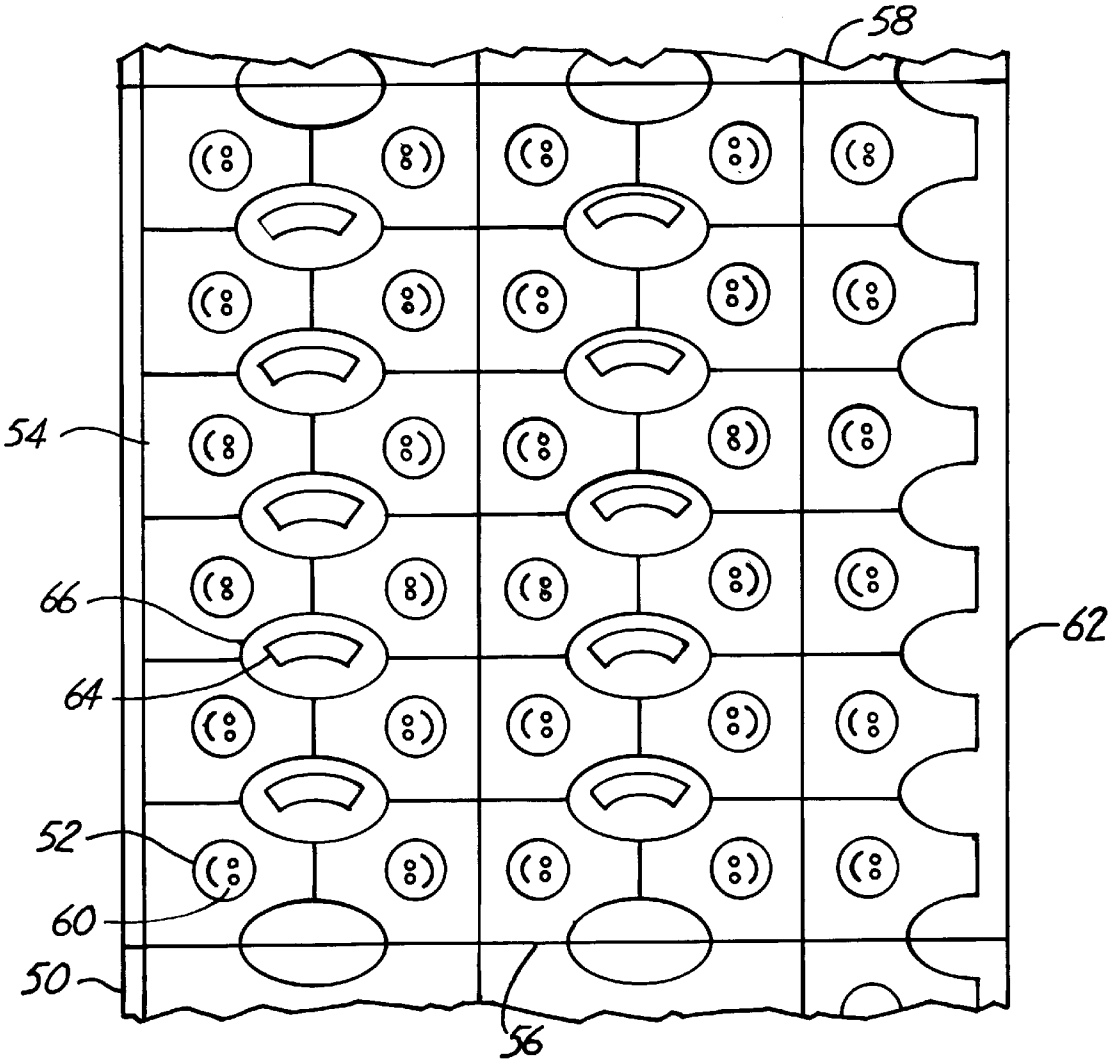
FIG. 5 is a plan view of the fabric illustrated in FIG. 4 with a layout or marker shown thereon.

FIG. 4 illustrates another form of a raw fabric panel printed in accordance with the present invention for use in cutting garment pieces as illustrated in FIG. 5. The embodiment illustrated in FIGS. 4 and 5 is particularly suitable for application of images using a rotary screen printing process. As shown in FIGS. 4 and 5, a portion of a bolt of fabric 50 includes a plurality of images 52, oriented oppositely across the width of the bolt. In the case of the embodiment illustrated in FIGS. 4 and 5, the images will appear on a single panel of the garment, such as the back panel 54. Also in this case, a common point on the images themselves may serve as the sight point for subsequent cutting of the garment pieces. The images may be printed as a repeated pattern based on the garment being constructed. For example, if the back panel pieces 54 of the garment are positioned to repeat at 25.12 inches (63.8 cm) along the length of the bolt of fabric 50, images 52 can be printed using a rotary actuator for rotary screen printing the images onto the fabric that is 8.0 inches (20.3 cm) in diameter. As in the case of the embodiment illustrated in FIGS. 2 and 3, cut lines 56 and 58 are established relative to a sight point 60. Sight point 60 does not need to be a separate sight point. Instead, sight point 60 may be a distinctive printed part of each image, or of one of the images on each panel 62 of fabric to be cut. Thus, in the "happy face" logo depicted in FIGS. 4 and 5, the sight point may be a portion of an eye closest to one corner of a panel 62. Additionally, other garment pieces, such as collar pieces 64 may be formed in unused portions 66 of the fabric.

While the embodiment illustrated in FIGS. 4 and 5 shows formation of the back panels of a plurality of garments, the panels may include any panels that include the positioned image. Moreover, while the pattern is shown repeated so that the shortest dimension of the garment piece is formed along the length of the bolt of fabric, arrangement may be in any convenient orientation, including arranging the garment pieces so the longest dimension is along the length of the bolt of fabric. The only limiting factor in selecting garment piece or panel orientation on the fabric is the pattern repeat for positioning the image on the fabric and cutting the fabric into the garment pieces. Thus, if the image is applied with a rotary applicator, as in rotary screen printing, a greater pattern repeat will require a rotary actuator having a larger diameter.

One feature of the present invention is that the fabric employed in the process may be any fabric on which images may be printed employing known printing processes. For example, fleece is a fabric that can be printed, but has not been fully utilized in displaying special images. More particularly, it is not altogether practical to print specifically located images onto a cut garment piece or assembled garment constructed with fleece. Instead, application of specifically located images to fleece garments has been limited to embroidering, sewing or application of separate decals to the fleece. With the present invention, it is practical to print the image directly onto the raw fleece (gray goods) and thereafter cut the garment pieces for assembly into a garment.

Figure 6:
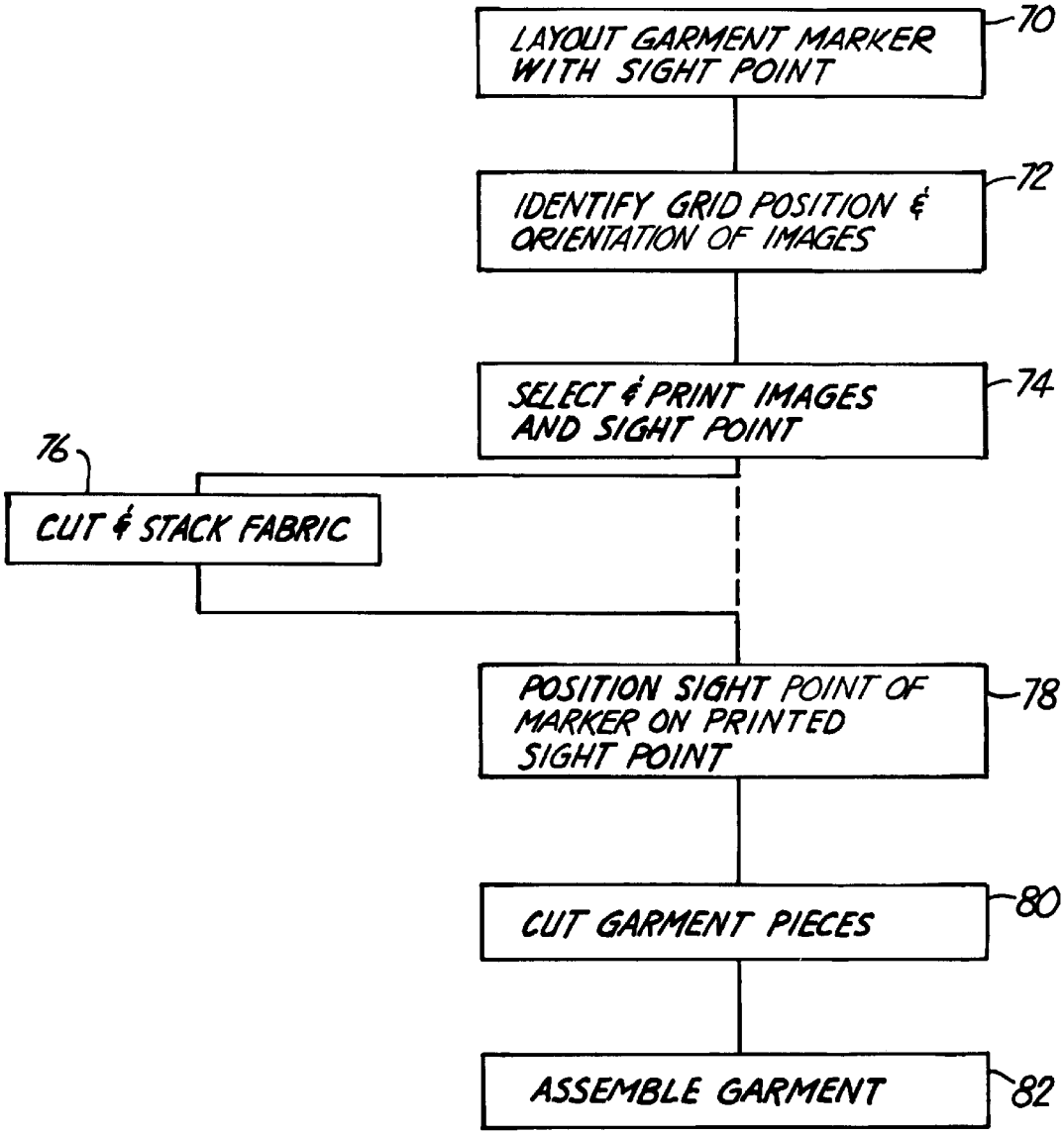
FIG. 6 is a flow chart of the process of making a garment according to the present invention.

The process of constructing the garment is illustrated in FIG. 6. At step 70, the garment marker is prepared with a sight point 30 or 62 and the garment pieces (10, 12, 14, 16, 18 and 20 in FIG. 2 or 54 in FIG. 4) such that each piece has clear boundaries and a seam allowance for its borders. The x,y grid position and orientation of the images to be placed on garment pieces, relative to sight point 30 or 62, is identified at step 72. With the position and orientation of the images identified, the images and sight point are printed on the fabric at step 74, resulting in the fabric illustrated in FIGS. 2 or 4. The images are positioned as established in the marker. If automated techniques are employed to cut the garment, fabric is cut at step 76 relative to the start point at the lines 32 and 34 (FIG. 2) or lines 56 and 58 (FIG. 4) so several plies of the fabric are stacked for cutting. At step 78, the marker is positioned relative to the fabric so that the sight point on the marker is aligned with the sight point on the fabric. If a paper marker is employed, the marker is applied to the top most layer of fabric. If the marker is encoded in the memory of a computer of an automated cutting device, the preprinted sight point 30 or 62 on the fabric is employed to position the cutting mechanism for the garment pieces based on the marker.

The garment pieces are cut at step 80 and the pieces are assembled into the finished garment at step 82. The resulting garment, illustrated in FIG. 1, includes the preprinted images positioned centrally, or as desired by the designer, on the garment pieces. Thus, the images do not extend into a seam between panels or pieces of the garment.

The present invention thus provides a technique of manufacturing garments with selected images printed thereon, without the need for post-assembly processing, as previously required. The technique is effective in operation and ideally suited for production of quantities of garments of small, medium and large lots.

Although the present invention has been described with reference to preferred embodiments, workers skilled in the art will recognize that changes may be made in form and detail without departing from the spirit and scope of the invention.

What is claimed is:

1. In a process of making a plurality of garments each displaying at least one image at a selected position and orientation on the garment, a process of making garment pieces containing the image comprising steps of:

a) creating a marker identifying a sight point and the bounds of a plurality of garment pieces, at least some of the garment pieces for displaying images at positions and orientations corresponding to the selected position and orientation;

b) printing at least one sight point and a plurality of images on a raw fabric so that the position and orientation of each printed image to the printed sight point corresponds to the position and orientation of the image for the corresponding garment piece of the marker to the sight point on the marker;

c) positioning the marker relative to the fabric so that the sight point on the marker is aligned to the sight point on the fabric; and d) cutting the fabric into garment pieces based on the bounds of the pieces on the marker.

2. The process of claim 1, wherein the raw fabric is part of a bolt of extended length, and the process further includes, between steps (b) and (c):

e) identifying at least one cut line across a width of the bolt relative to the sight point, and f) cutting the fabric at the cut lines to form a plurality of plies of fabric.

3. The process of claim 2, further including, after step (f), stacking the plies.

4. The process of claim 3, wherein step (c) is performed by applying the marker to the top-most ply of fabric of the stack, and step (d) is applied to the stack to cut all of the plies of fabric of the stack simultaneously.

5. The process of claim 2, wherein step (b) includes printing the plurality of images in a pattern that repeats along a length of the raw fabric between successive cut lines.

6. The process of claim 5, wherein step (b) includes printing a single sight point between successive cut lines.

7. The process of claim 5, wherein step (b) is performed by a rotary applicator.

8. The process of claim 5, further including, after step (f), stacking the plies, and wherein step (c) is performed by applying the marker to the top-most ply of fabric of the stack, and step (d) is applied to the stack to cut all of the plies of fabric of the stack simultaneously.

9. The process of claim 1, wherein the sight point is part of at least one of the images.

10. A process of making a plurality of garments each having at least one desired image at a selected position and orientation on the garment, the process comprising steps of:

a) creating a marker identifying a sight point and the bounds of a plurality of garment pieces, at least some of the garment pieces for displaying images at positions and orientations corresponding to the selected positions and orientations;

b) printing at least one sight point and a plurality of images on a raw fabric so that the position and orientation of each printed image to the printed sight point corresponds to the position and orientation of the image for the corresponding garment pieces of the marker to the sight point on the marker;

c) positioning the marker relative to the fabric so that the sight point on the marker is aligned to the sight point on the fabric;

d) cutting the fabric into garment pieces based on the bounds of the pieces on the marker; and e) assembling a garment containing at least one garment piece that bears the printed image in the selected position and orientation.

11. The process of claim 10, wherein the raw fabric is part of a bolt of extended length, and the process further includes, f) identifying at least one cut line across a width of the bolt relative to the sight point, and before step (c), g) cutting the fabric at the cut lines to form a plurality of plies of fabric, and h) stacking the plies.

12. The process of claim 11, wherein step (c) is performed by applying the marker to the top-most ply of fabric of the stack, and step (d) is applied to the stack to cut all of the plies of fabric of the stack simultaneously.

13. The process of claim 11, wherein step (b) includes printing the plurality of images in a pattern that repeats along a length of the raw fabric between successive cut lines.

14. The process of claim 13, wherein step (b) is performed by a rotary applicator.

15. The process of claim 13, wherein step (c) is performed by applying the marker to the top-most ply of fabric of the stack, and step (d) is applied to the stack to cut all of the plies of fabric of the stack simultaneously.

16. The process of claim 10, wherein the sight point is part of at least one of the images.

* * * * *